US010934874B2

(12) United States Patent
Sanzari et al.

(10) Patent No.: US 10,934,874 B2
(45) Date of Patent: Mar. 2, 2021

(54) ASSEMBLY OF BLADE AND SEAL FOR BLADE POCKET

(71) Applicant: PRATT & WHITNEY CANADA CORP., Longueuil (CA)

(72) Inventors: Lorenzo Sanzari, Montreal (CA); Othmane Leghzaouni, Brossard (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 16/269,066

(22) Filed: Feb. 6, 2019

(65) Prior Publication Data

US 2020/0248576 A1 Aug. 6, 2020

(51) Int. Cl.
*F01D 11/00* (2006.01)
*F01D 5/14* (2006.01)

(52) U.S. Cl.
CPC ..... *F01D 11/006* (2013.01); *F01D 5/147* (2013.01)

(58) Field of Classification Search
CPC ... F01D 5/10; F01D 5/147; F01D 5/26; F01D 11/006; F01D 25/06; F05D 2220/32; F05D 2240/24; F05D 2220/55; F05D 2260/96; F05D 2300/20
See application file for complete search history.

(56) References Cited

U.S. PATENT DOCUMENTS 4,872,812 A * 10/1989 Hendley ..... F01D 11/008 416/190
5,415,526 A * 5/1995 Mercadante ..... F01D 5/081 416/190
5,573,375 A * 11/1996 Barcza ..... F01D 5/22 416/193 A
5,746,578 A * 5/1998 Brassfield ..... F01D 5/22 416/190
6,786,696 B2 * 9/2004 Herman ..... F01D 5/147 416/193 A
9,022,727 B2 5/2015 Borufka et al.
9,587,495 B2 3/2017 Beattie et al.
9,797,270 B2 10/2017 O'Leary
9,810,075 B2 11/2017 Lana et al.
2007/0134099 A1 * 6/2007 Lee ..... F01D 11/006 416/193 A
2013/0195665 A1 * 8/2013 Snyder ..... F01D 5/22 416/174
2014/0271205 A1 * 9/2014 Marasco ..... F01D 11/006 416/193 A
2014/0369844 A1 12/2014 Hansom et al.
2016/0222800 A1 * 8/2016 Kleinow ..... F01D 5/147

* cited by examiner

*Primary Examiner* — Igor Kershteyn
(74) *Attorney, Agent, or Firm* — Norton Rose Fulbright Canada LLP

(57) ABSTRACT

An assembly comprising a blade including a blade portion, a root portion and a platform portion between the blade portion and the root portion, the platform portion defining at least one cavity opened laterally. An abutment projects from a wall portion of the cavity at a trailing end of the blade. A seal is received in the cavity and positioned along a periphery of the cavity, the seal having a trailing edge abutting against the abutment.

18 Claims, 4 Drawing Sheets

ASSEMBLY OF BLADE AND SEAL FOR BLADE POCKET

TECHNICAL FIELD

The application relates to rotor assemblies of the type found in gas turbine engines, and more particularly to sealing such assemblies.

BACKGROUND

Feather seal designs are used to interface with blade pocket cavities. These seals may be located along a gap extending between adjacent blade platforms. Such seals may have the form of an "inverted u-shape" design with forward and rear legs that extend beyond the blade platform. These legs may be used to block the seal from moving inside the blade/disc cavity. The seal efficiency relies on the seal being properly inserted in the cavity, for the seal to contact the surface of the cavity along the gap. As the cavities may be asymmetric from leading edge to trailing edge, the seal may also have an asymmetric shape from forward leg to rear leg (e.g., the rear leg being longer). Accordingly, there is a risk that a seal may be misinstalled, and this may affect the efficiency of the sealing action.

SUMMARY

In one aspect, there is provided a blade comprising a blade portion, a root portion and a platform portion between the blade portion and the root portion, the platform portion defining at least one cavity opened laterally and configured for receiving a seal therein along a periphery of the cavity, an abutment projecting from a wall portion of the cavity at a trailing end of the blade, the abutment configured for abutment with a trailing edge of the seal.

In another aspect, there is provided an assembly comprising a blade including a blade portion, a root portion and a platform portion between the blade portion and the root portion, the platform portion defining at least one cavity opened laterally, an abutment projecting from a wall portion of the cavity at a trailing end of the blade, and a seal received in the cavity and positioned along a periphery of the cavity, the seal having a trailing edge abutting against the abutment.

DESCRIPTION OF THE DRAWINGS

Reference is now made to the accompanying figures in which.

DETAILED DESCRIPTION

Figure 1:
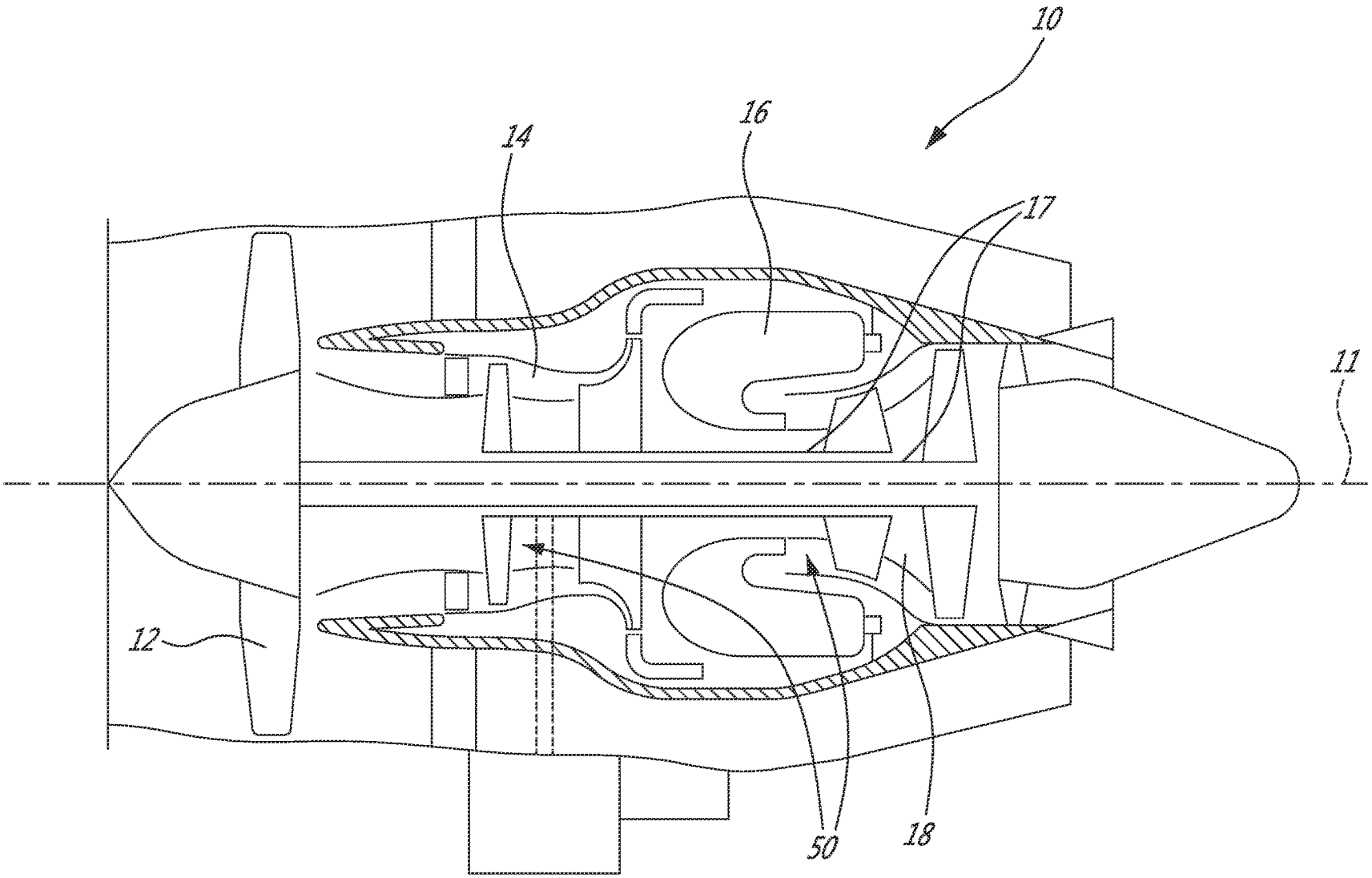
FIG. 1 is a schematic cross-sectional view of a gas turbine engine featuring a blade and seal assembly of the present disclosure.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. One or more shaft(s) 17 is/are in driving engagement with other rotating parts of the engine 10 in the compressor section 14 and the turbine section 18.

Figure 2:
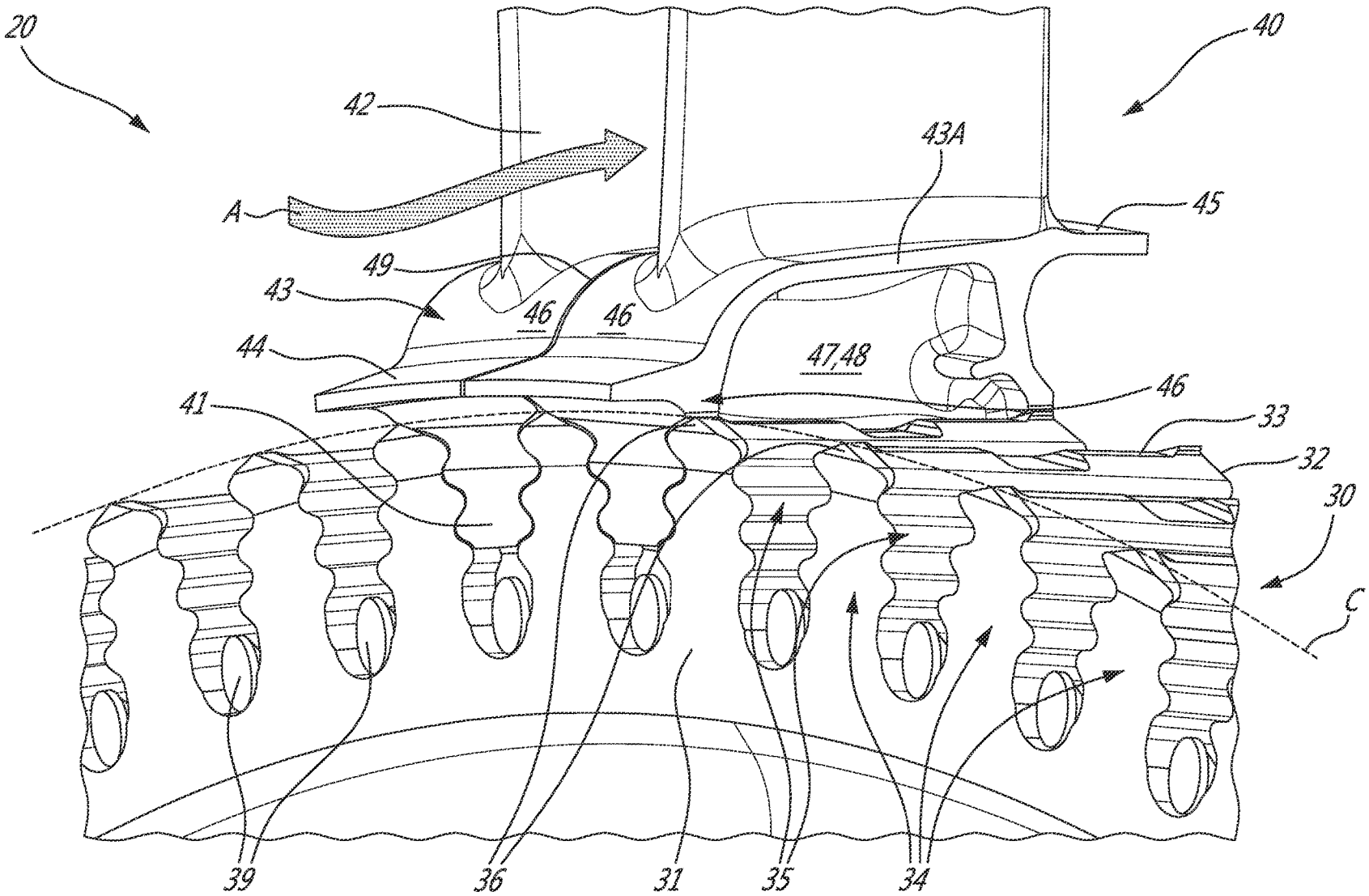
FIG. 2 is an isometric view of a rotor assembly with blades on a disc in accordance with the present disclosure.
Figure 3:
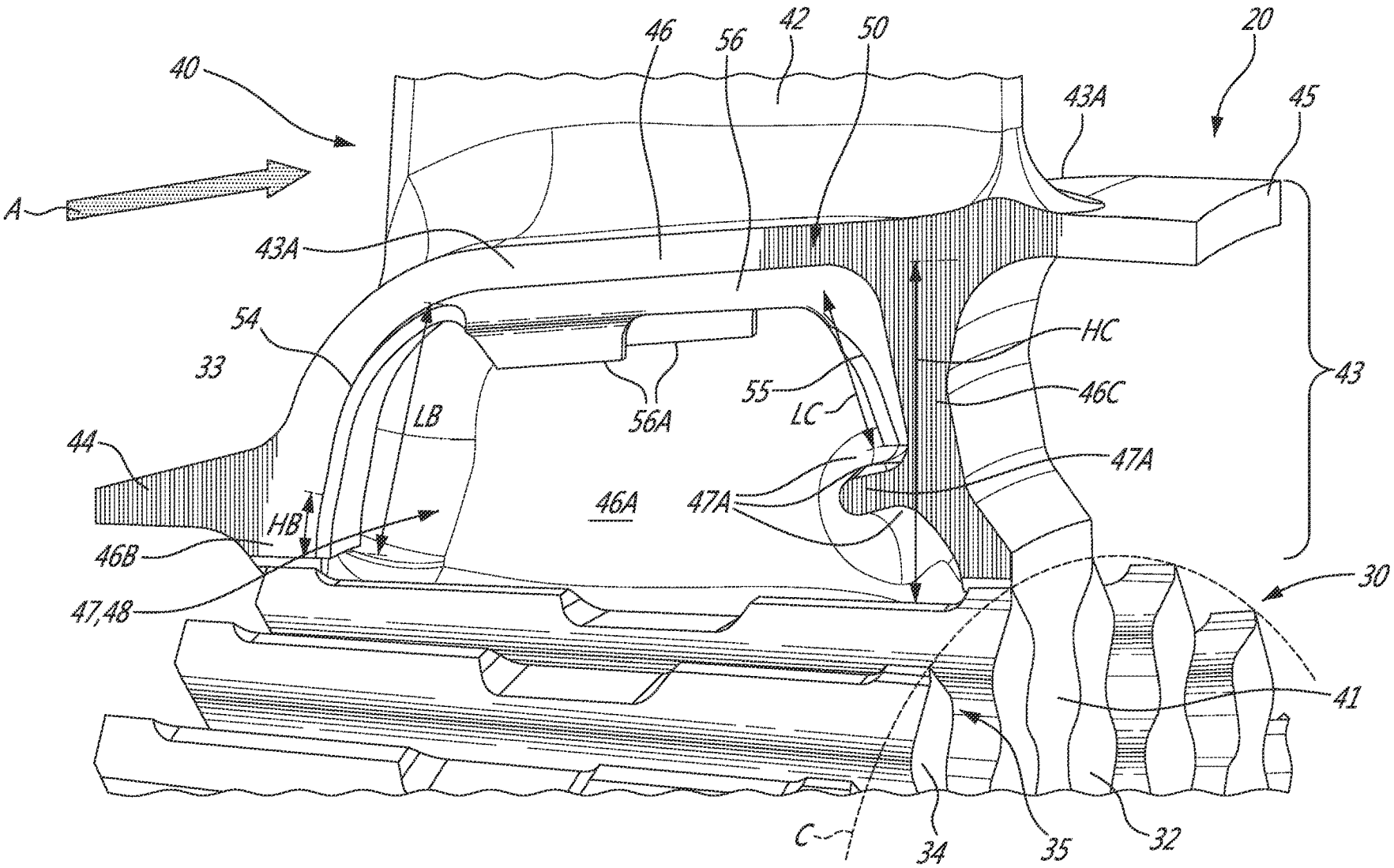
FIG. 3 is an elevation view of a blade and seal assembly of the present disclosure.

Referring to FIGS. 2 and 3, an embodiment of a rotor assembly 20 for the gas turbine engine 10 is partially shown. The rotor assembly 20 may be any suitable component of the compressor section 14 or turbine section 18 which includes a rotor disc 30 (partially shown) and rotor blades 40 surrounding and rotating with a shaft 17 along an axis 11 (FIG. 1) of the engine 10. In an embodiment, the rotor assembly 20 may form part of an axial compressor disposed in an air passage of the compressor section 14. In another embodiment, the rotor assembly 20 may form part of an axial turbine disposed in a passage 50 of the combustion gases for extracting the energy from the combustion gases in the turbine section 18.

In an embodiment, the rotor assembly 20 comprises a rotor disc 30 and a plurality of rotor blades 40 disposed circumferentially about and connected to the rotor disc 30. The blades 40 may be disposed circumferentially about the disc 30 in more than one row implementing axial stages of the rotor assembly 20. These stages may correspond to compression stages or pressure stages in certain embodiments. The blades 40 may or may not be equally circumferentially spaced apart from one another about the disc 30, but they are typically equally spaced apart from one another.

In embodiments, such as where the rotor assembly 20 may be disposed downstream of the combustor 16 in the turbine section 18, the components of the rotor assembly 20 may have to sustain high pressures and temperatures during operation of the engine 10. Such operating conditions may affect the durability of said components. Hot combustion gases and/or air upstream of the rotor assembly 20 may infiltrate interstitial spaces between components connecting/interfacing together in the rotor assembly 20. Minimizing such air leakage passages at interfaces between components of the rotor assembly 20 may be desirable in order to limit (reduce) the rate at which these components heat up during normal operation of the engine 10 and/or so as not to limit the negative impacts of infiltration on the efficiency of the gas turbine engine 10. As discussed below, components of the rotor assembly 20 may be adapted to minimize air leakage passages at selected locations about the disc 30 and/or between adjacent blades 40, more particularly at a disc/blades interface.

The disc 30 has a front end portion 31, an opposite rear end portion 32 axially spaced apart therefrom, and a peripheral surface 33 circumferentially extending about the disc 30 between the front end portion 31 and the rear end portion 32. The front end portion 31 may define a front end surface and the rear end portion 32 may define a rear end surface of the disc 30 between which the peripheral surface 33 of the disc 30 may extend. In an embodiment, the end surfaces are substantially parallel relative to each other and substantially perpendicular relative to the axis 11 of the engine 10. The front end surface and/or the rear end surface may form flat plane portions, to which the axis 11 is normal when the rotor assembly 20 is installed in the engine 10. For example, either or both of the end surfaces may form flat annular portions, such as a flat peripheral ring or band, where the disc 30 connects to the blades 40. In an embodiment, the front end surface may be an upstream surface of the rotor assembly 20 relative to a direction of the flow path of combustion gases in the turbine section 18. In another embodiment, the rear end surface may be the upstream surface of the rotor assembly 20 in the compressor section 14. Thus, in the compressor section 14, a differential pressure of the air across the compressor rotor may act on the front surface of the disc 30, and in the turbine section 18, a differential pressure of the combustion gases across the turbine rotor may act on the front surface of the disc 30. In other words, a force derived from the differential pressure across the rotor assembly 20 acts on the front end surface during the normal operation of the gas turbine engine 10.

The disc 30 has a plurality of fixing members 34 defined therein through the peripheral surface 33 and circumferentially spaced apart from one another. The fixing members 34 may extend axially from the front end portion 31 to the rear end portion 32 of the disc 30. The fixing members 34 may be radial projections of the disc 30, with each fixing member 34 being substantially radial. The disc 30 may include a plurality of profiled slots 35 defined therein through the peripheral surface 33, between pairs of adjacent ones of the fixing members 34. In an embodiment, the slots 35 may extend generally axially. Therefore, the disc 30 may have an alternating sequence of fixing members 34 and slots 35. In an embodiment, the machining or like fabricating of the slots 35 results in the presence of the fixing members 34. As the fixing members 34 and the slots 35 are side by side and define each other, they have complementary shapes. In an embodiment, the slots 35 may extend axially from the front end surface to the rear end surface of the disc 30, in which a front slot opening and a rear slot opening may be respectively defined. In other embodiments, the slots 35 may not extend all the way through an axial width of the disc 30, as the slots 35 may have an axial dimension smaller than the axial width of the disc 30. Stated differently, the rear end surface of the disc 30 may not define a rear slot opening. In some embodiments, the slots 35 may be slightly skewed relative to a longitudinal axis of the rotor assembly 20. The slots 35 may be any suitable groove, opening and/or recess formed in the peripheral surface 33 of the disc 30 to receive a generally complementary portion of one of the blades 40, which may be a root portion of the blades 40 as discussed later, in order to thereby connect, secure and/or attach the blade 40 onto the disc 30.

In an embodiment, the fixing members 34 may have a profiled contour which may be, for example, formed by a series of lobes having decreasing circumferential widths from the radially outermost lobe ("top lobe"), to the radially innermost lobe ("bottom lobe"), with the radially central lobe ("mid lobe") disposed therebetween and having an intermediate lobe width. Such a multi-lobed profiled contour is typically referred to as a firtree, because of this characteristic shape. It is to be understood from the above that the slots 35 may have a complementary firtree shape, as in some embodiments side walls of the slots 35 may each define a respective side of the profiled contour of the fixing members 34. Whether or not in the shape of a firtree or lobes, the fixing members 34 and slots 35 define mechanical interferences that form abutments the prevent a radial outward movement of blades 40 connected to the disc 30. Opposite sides of the profiled contour of the fixing members 34 may converge/taper at a tip portion 36 of each one of the fixing members 34. Stated differently, an outer periphery of each fixing member 34, including its tip portion 36, may have a firtree shape. The fixing members 34 and slots 35 may have other profiled shapes in some embodiments.

Referring to FIG. 2, two of the multiple blades 40 are shown, whereas FIG. 3 shows a single one of the blades 40. Others are removed so as to illustrate components of the blades 40. In an embodiment, blades 40 are provided for each of the slots 35, with the blades being side by side to form the rotor assembly 20. In an embodiment, all blades 40 are substantially the same. There may be differences in blades 40, for example do to uses, or due to the presence of given features such as cutouts, etc.

An exemplary one of the blades 40 has a blade root portion 41, an airfoil portion 42 and/or a platform or platform segments 43 between the blade root portion 41 and the airfoil portion 42. The platform or platform segment 43 may extend laterally as projections 43A relative to the sides of the airfoil portion 42. Therefore, such projections 43A may be into opposing relationship with corresponding platform segments 43 of adjacent ones of the blades 40. These projections 43A may consequently form an annulus portion of the blade 40.

The blade root portion 41 of each blade 40 may be received in a corresponding slot 35 of the disc 30. The root portion 41 may have a shape and size that dovetails with the shape and size of the corresponding slot 35. The size of the blade root portions 41 may be slightly smaller than or equal to the size of the slots 35 to allow the blade root portions 41 to slide within the slots 35 when connecting the blades 40 to the disc 30. Once received in the slot 35, the blade root portion 41 may be secured therein with a retaining member 39. The retaining member 39 may be any fastening structure such as a retaining ring, a rivet connector or any other suitable types of retaining member that may connect the blade root portions 41 and axially block it in inside respective slots 35 to prevent axial movement between the blade root portions 41 and the slots 35.

The airfoil portion 42 of each blade 40 may extend generally or partially transversally to the direction of the flow path of air/combustion gases in the air/combustion gases passage A. The airfoil portion 42 may have a profiled shape adapted to generate a pressure/velocity differential across the rotor assembly 20 (or a section thereof) when air/combustion gases flow across the airfoil portions 42 when the rotor assembly 20 rotates during operation of the engine 10.

One or more of the platform segments 43 may have a curved profile forming a leading flange 44 protruding forwardly. One or more of the platform segments 43 may have a trailing flange 45 protruding rearwardly. The projections 43A may be between the flanges 44 and 45 so as to define a smooth continuous wall 46. This wall may be an annular segment, as the annular segments of side-by-side blades 40 may form an annular surface from which the airfoil portions 42 project generally radially. This combined annular surface may be known as a the platform of the rotor assembly 20, and/or as the platform rail of the rotor assembly 20. In an embodiment, the width of the platform segments 43 is generally uniform or constant from the leading end of the flange 44, through the projections 43A and to the trailing end of the flange 45.

The platform segments 43 may include a web portion 46A projecting downwardly from the wall 46. The web portion 46A may be the part of the platform segments 43 that merges into or becomes the blade root portion 41. In another embodiment, the web portion 46A may be regarded as being part of the blade root portion 41. The web portion 46A may be seen as a portion of the blade root portion 41 that is radially outward of a radial-most circumference C incorporating the peripheral edges 33 of the disc 30. Shoulder portions 46B and 46C may project radially inwardly from the wall 46. In an embodiment, the platform segments 43 may be without the shoulder portions 46B and/or 46C, with the wall 46 having instead an inverted U-shape, for example with or without the flanges 44 and/or 45 at its ends. If present, the shoulder portions 46B and/or 46C may be generally transverse to the web portion 46A. As shown in FIGS. 2-5, a fillet or fillets may be present at a junction between the wall 46, the web portion 46A, and the shoulder portions 46B and 46C. The wall 46 and the web portion 46A, and the shoulder portions 46B and/or 46C if present, may define a cavity 47 underneath each airfoil portion 42. In FIG. 3, one side of the blade 40 is shown, by the other side may have a similar construction and also have the cavity 47. The cavities 47 may also be known as recesses, subpockets, depressions, pocket portions, etc. In an embodiment, the opposite sides of the platform segments 43 are mirror images of one another. The cavities 47 may be present as a result of limiting the weight of the blades 40, while forming the annular surface consisting of the side by side walls 46 of adjacent blades 40. The shoulder portion 46C may have a height HC from the wall 46 to its contact with the disc 30 (e.g., at circumference C) or to the root portion 41 that is greater than the height HB of the shoulder portion 46B, i.e., the height HB being from the junction of the shoulder portion 46B from the wall 46 to its contact with the disc 30 (e.g., at circumference C) or the root portion 41. As FIGS. 2 and 5 may be to scale to represent an embodiment, the following condition may apply: HC≤3HB.

An abutment 47A, a.k.a, stop may project into the cavity 47. If there are cavities 47 on both sides of the platform segments 43, each cavity 47 may have the abutment 47A, or a single one of the cavities 47 may have the abutment 47A. In the embodiment of FIGS. 2 and 3, the abutment 47A projects from both the web portion 46A and from the shoulder portion 46C. The abutment 47A may merge with the web portion 46A and/or the shoulder portion 46C by way of fillets 47A1. The abutment 47A is more than a fillet in that its shape may have generally planar surfaces or the like that have a different radius of curvature than adjacent fillets 47A1. In an embodiment, the abutment 47A is generally transverse to the web portion 46A and/or the shoulder portion 46C ("generally transverse" meaning at an angle ranging from 75 degrees to 105 degrees. The abutment 47A may have its opposed surfaces generally circumferentially oriented relative to an axis of rotation 11 of the blade 40 on a disc 30. In an embodiment, the abutment 47A may be regarded as a disruption from the otherwise continuous surfaces of the walls from which it projects, e.g., the web portion 46A and the shoulder portion 46C. As projects generally transversely from other surfaces (e.g., surfaces of the web portion 46A and the shoulder portion 46C), the abutment 47A may be a stress reliever, by reducing local stresses in the web portion 46A and/or the shoulder portion 46C. The abutment 47A may increase the local stiffness. In an embodiment, the local stress at the location of the abutment 47A is relatively higher than at other locations of the platform segments 43. The local stress may be relatively higher due to blade twisting and/or to an increased pull caused by the shoulder portion 46C. The shoulder portion 46C is therefore subjected to stresses that may not be sustained by the shoulder portion 46B, because of its superior dimension. The wall 46 may delimit the main gas path through the rotor assembly 20, whereby a pressure differential may be during operation between the gas path pressure and the cavity 47. Moreover, there may be another pressure differential across present across the shoulder portion 46C, between the cavity 47 and an environment downstream of the rotor assembly 20. For example, when the rotor assembly 20 is part of a compressor, the downstream pressure may be greater than in the cavity 47, whereby the shoulder portion 46C may be subjected to additional stresses. In an embodiment, the shoulder portion 46C sustains the relatively highest stresses in the components of the platform segment 43. This is an example, as in other arrangements, the higher stresses may be in the shoulder portion 46B. Consequently, the presence of the abutment(s) 47A in the cavity 47 may strengthen the blade 40 by its stiffening function, and may result in the blade 40 being lighter than a blade 40 with the abutment 47A. The abutment (s) 47A may assist in distributing the stresses.

When the blades 40 are mounted on the disc 30, corresponding platform segments 43 of adjacent ones of the blades 40 may mate in opposing relationship, such that the platform cavities 47 under the corresponding platform segments 43 may together define a blade pocket 48, i.e., a global recess 48. Stated differently, the pocket 48 may be circumscribed by the adjacent platform segments 43 of respective adjacent blades 40. The pocket 48 may also be defined by the peripheral surface 33 of the disc 30 when the blades 40 are mounted thereon. If only one side of the blades 40 has a cavity 47, the pocket 48 may be defined by the cavity 47 of one blade, and a smooth surface of an adjacent blade, such as a the web portion 46A of an adjacent blade.

When the blades 40 are installed side by side and form the pockets 48 between them, the walls 46 of the platform segments 43 from the generally continuous annular surface positioned about a rotational axis of the rotor assembly 20. However, gaps 49 (see FIG. 2) may be defined between side edges of adjacent platform segments 43. More particularly, such gap 49 may extend from the leading flange 44 through the projections 43A to the trailing flange 45, and may be regarded as an axial gap for the axial orientation. The gap 49 may also be referred to as a gap as it is in the circumference of the annular platform. Stated differently, the gaps 49 may be along sides edges of adjacent platform segments 43.

Referring to FIG. 3, in some embodiments, the pocket 48 may contain a seal 50 that may seal the gap 49 defined between side edges of adjacent platform segments 43. In an embodiment, the seal 50 may be known as a feather seal, a damper seal, etc. The seal 50 may contribute to minimizing air leakage between adjacent platform segments 43 of the rotor assembly 20. A cross-section of the seal 50 that is applied against the gap 49 may be elongated, so as to be substantially wider than the width of the gap 49. Moreover, the cross-section may me relatively flat, so as to apply against the surface of the pocket 48. The seal 50 may have a U-shape or C-shape. The shape of the seal 50 may be such as to emulate the surface of the cavities 47/pocket 48, for the seal 50 to be against the surface along the gap 49. With such shapes, the seal 50 may have a leading leg 54, a trailing leg 55, and a central portion 56. The leading leg 54 has a leading edge 54A that may contact the radially inwardmost surface of the pocket 48, or be in proximity thereto. In the embodiment, the radially inwardmost surface of the pocket 48 is delimited by the peripheral surface 33 of the disc 30. When installed, the leading leg 54 is adjacent to the leading end of the platform segment 43, namely the one with the flange 44. The trailing leg 55 has a trailing edge 55A that may contact the abutment 47A. When installed, the trailing leg 55 is adjacent to the trailing end of the platform segment 43, namely the one with the flange 45. The central portion 56 applies against a radially inward surface of the wall 46. Tab(s) 56A may project laterally and inwardly from the central portion 56. The tab(s) 56A may apply against a surface of the web portion 46A, to increase a contact area between the seal 50 and the surface of the pocket 48.

Figure 4:
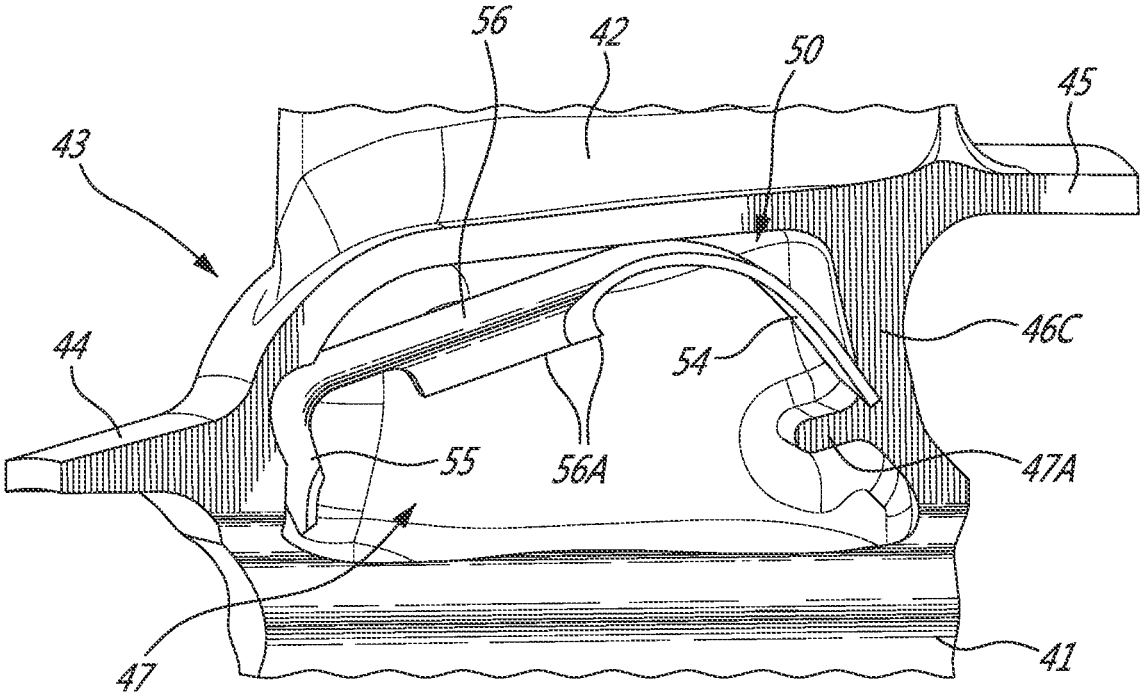
FIGS. 4 and 5 are elevation views of exemplary mechanical interference in an installation of a seal in the blade of the present disclosure.
Figure 5:
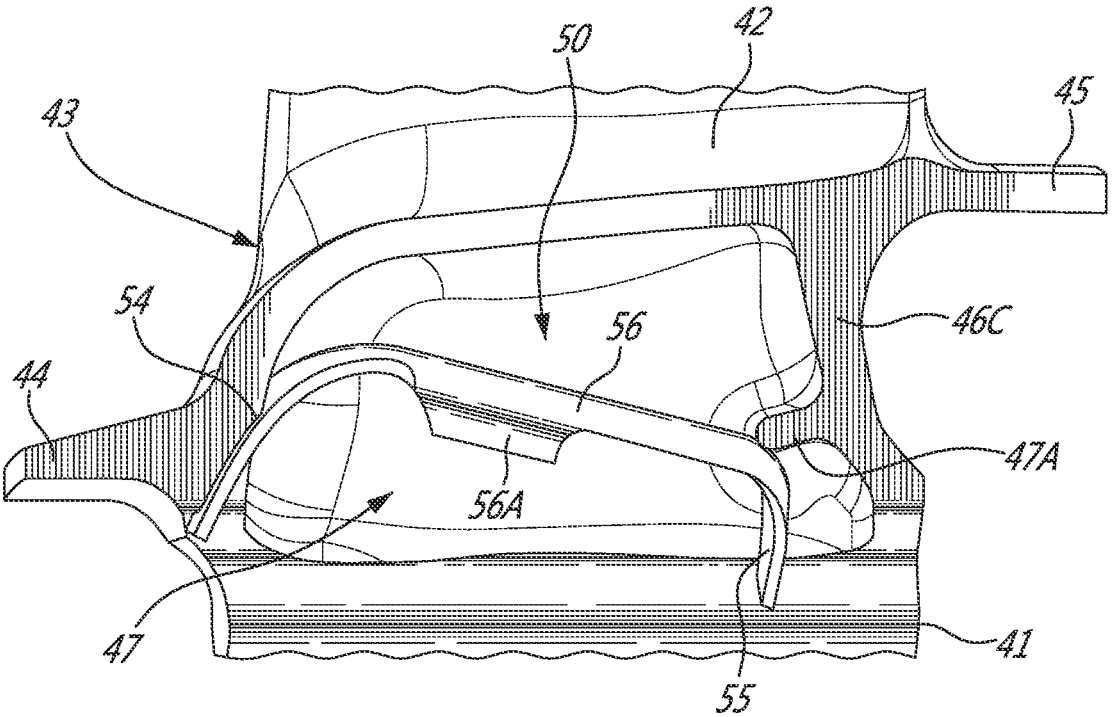

The length LC of the trailing leg 55 from the central portion 56 is shorter than the length LB of the leading leg 54 from the central portion 56, due to the presence of the abutment 47A. As FIGS. 2 and 5 may be to scale to represent an embodiment, the following condition may apply: LB≤1.25LC. The relation could also be relation LB≤2.0LC As shown in FIGS. 4 and 5, due to the relation LB≤1.25LC and to the presence of the abutment 47A that forms an obstruction in the pocket 48, the installation of the seal 50 with the trailing leg 55 forward would result in mechanical interference. This may be indicative of an improper seal placement. In an embodiment, the collaboration between the abutment 47A and the seal 50 may act as a mistake-proofing feature to ensure that the seal 50 is not misinstalled.

Because of the relation LB≤1.25LC may result in a lighter seal 50 as the trailing leg 55 is shorter as it does not have to extend all the way to the peripheral surface 33 of the disc 30. The lighter seal 50 may also have an increased life as it is shorter. The load applied to the surface of the pocket 48 by the seal 50 may also be reduced the load transmitted by the lighter and shorter seal 50. In turn, this enables to design a lighter blade with reduced stresses. The arrangement including the abutment 47A may constrain the seal 50 in the forward and rear direction, and thus prevent or block the seal 50 from rocking and turning within the pocket 48. This may for instance ensure constant contact of the seal 50 with the surfaces defining the blade pocket 48.

The above description is meant to be exemplary only, and one skilled in the art will recognize that changes may be made to the embodiments described without departing from the scope of the invention disclosed. The seal 50 may be said to be asymmetric from end 54 to 55. The seal 50 may or may not be symmetric about a plane cutting the seal 50 lengthwise (e.g., the plane incorporation the axis of rotation 11). In an embodiment, the abutment 47A is located in such a way that the seal 50 may be symmetric lengthwise with LA=LC. Still other modifications which fall within the scope of the present invention will be apparent to those skilled in the art, in light of a review of this disclosure, and such modifications are intended to fall within the appended claims.

The invention claimed is:

1. A blade comprising a blade portion, a root portion and a platform portion between the blade portion and the root portion, the platform portion defining at least one cavity opened laterally and configured for receiving an asymmetric seal therein along a periphery of the cavity, the seal having a leading leg and a trailing leg joined by a central portion, the leading leg being longer than the trailing leg, the cavity including a trailing shoulder portion extending from the platform portion to the root portion at a trailing end of the blade, an abutment projecting from the trailing shoulder portion along a height of the trailing shoulder portion between the platform portion and the root portion, the abutment configured for abutment with a trailing edge on the trailing leg of the seal.

2. The blade according to claim 1, wherein the platform portion has a wall configured for being an annular segment of an annular platform of a plurality of the blades on a disc, a radial inward portion of the wall defining part of the at least one cavity.

3. The blade according to claim 2, wherein the at least one cavity is further defined by a web portion extending from the wall to the root portion.

4. The blade according to claim 3, wherein the abutment projects from the web portion and the trailing shoulder portion.

5. The blade according to claim 4, wherein the abutment is generally transverse to the web portion and the trailing shoulder portion.

6. The blade according to claim 4, wherein at least one fillet is located at a junction between the abutment, the web portion and/or the trailing shoulder portion.

7. The blade according to claim 3, wherein the at least one cavity is further defined by a leading shoulder portion extending from the wall to the root portion.

8. The blade according to claim 7, wherein the trailing shoulder portion has a height HC from the wall to the root portion, the leading shoulder portion has a height HB from the wall to the root portion, and wherein HC≥3HB.

9. The blade according to claim 1, wherein the abutment has opposed surfaces generally circumferentially oriented relative to an axis of rotation of the blade on a disc.

10. The blade according to claim 1, comprising one said cavity on each side of the blade.

11. The blade according to claim 10, wherein each said cavity has one of the abutment.

12. An assembly comprising a blade including a blade portion, a root portion and a platform portion between the blade portion and the root portion, the platform portion defining at least one cavity opened laterally, an abutment projecting from a wall portion of the cavity at a trailing end of the blade, and an asymmetric seal received in the cavity and positioned along a periphery of the cavity, the seal having a leading leg and a trailing leg joined by a central portion, the leading leg being longer than the trailing leg, the leading leg having a free end abutting against the periphery of the cavity, the trailing leg having a trailing edge abutting against the abutment.

13. The assembly according to claim 12, wherein the platform portion has a wall configured for being an annular segment of an annular platform of a plurality of the blades on a disc, a radial inward portion of the wall defining part of the at least one cavity.

14. The assembly according to claim 13, wherein the at least one cavity is further defined by a web portion and a trailing shoulder portion extending from the wall to the root portion, the abutment projecting from the web portion and the trailing shoulder portion.

15. The assembly according to claim 14, wherein the abutment is generally transverse to the web portion and the trailing shoulder portion.

16. The assembly according to claim 12, wherein the abutment has opposed surface being generally circumferentially oriented relative to an axis of rotation of the blade on a disc.

17. The assembly according to claim 12, wherein the leading leg has a length LB from the central portion, the trailing leg has a length LC from the central portion, and wherein LB≥1.25LC.

18. The assembly according to claim 12, wherein at least one tab projects laterally and radially inwardly from the central portion.

* * * * *